US008531345B2

(12) United States Patent
Ito et al.

(10) Patent No.: US 8,531,345 B2
(45) Date of Patent: Sep. 10, 2013

(54) ANTENNA DEVICE AND RADIO COMMUNICATION TERMINAL

(75) Inventors: Hiroki Ito, Tokyo (JP); Tomokazu Fujiwara, Chiba (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 290 days.

(21) Appl. No.: 13/163,277

(22) Filed: Jun. 17, 2011

(65) Prior Publication Data

US 2012/0139812 A1 Jun. 7, 2012

Related U.S. Application Data

(60) Provisional application No. 61/418,693, filed on Dec. 1, 2010.

(51) Int. Cl.
*H01Q 21/00* (2006.01)

(52) U.S. Cl.
USPC ..... 343/853; 343/860; 343/702

(58) Field of Classification Search
USPC ..... 343/853, 860, 722, 702
See application file for complete search history.

(56) References Cited

U.S. PATENT DOCUMENTS

| | | | | |
|---|---|---|---|---|
| 7,411,557 | B2 * | 8/2008 | Shimizu et al. | 343/702 |
| 2007/0139282 | A1 * | 6/2007 | Haruyama | 343/702 |
| 2010/0022197 | A1 * | 1/2010 | Kato et al. | 455/75 |
| 2010/0225543 | A1 * | 9/2010 | Kakitsu et al. | 343/702 |

FOREIGN PATENT DOCUMENTS

| | | |
|---|---|---|
| JP | 2004-274445 | 9/2004 |
| JP | 2005-260762 | 9/2005 |
| JP | 2007-104637 | 4/2007 |

* cited by examiner

*Primary Examiner* — Dieu H Duong
(74) *Attorney, Agent, or Firm* — Oblon, Spivak, McClelland, Maier & Neustadt, L.L.P.

(57) ABSTRACT

An antenna device includes a first antenna element resonating at a frequency in a first frequency band, a first matching circuit attaining matching between a first radio frequency circuit and the first antenna element, a second antenna element resonating at a frequency in a second frequency band, a second matching circuit attaining matching between a second radio frequency circuit and the second antenna element, a first band-pass circuit connected with the second antenna element and the second matching circuit to selectively conduct a signal in the second frequency band and a second band-pass circuit connected with the second antenna element and grounded to selectively conduct a signal in the first frequency band, wherein the second antenna element is utilized as a parasitic element for the first antenna element.

18 Claims, 13 Drawing Sheets

IMPEDANCE OF PARASITIC ELEMENT

ANTENNA DEVICE AND RADIO COMMUNICATION TERMINAL

CROSS REFERENCE TO RELATED APPLICATION

The present application claims the benefit of the earlier filing date of U.S. provisional patent application 61/418,693, filed on Dec. 1, 2010, the entire contents of which being incorporated herein by reference.

BACKGROUND

1. Technical Field

The present disclosure relates to an antenna device using parasitic elements and a radio communication device using the antenna device.

2. Description of the Related Art

A radio communication terminal represented by, for example, a cell phone terminal includes an antenna device which is used for radio communication. In recent years, it is practiced to equip a feed antenna to which the power is fed with a parasitic element to be capacitive-coupled to an antenna element of the feed antenna in order to improve the characteristic of the antenna device.

In addition, a radio communication terminal which includes a plurality of antennas in order to cope with a plurality of communication systems is also proposed. FIG. 1 is a diagram illustrating an example in which in a radio communication terminal including first and second antennas, where a parasitic element is prepared for one (in the example illustrated in FIG. 1, the first antenna) of the antennas. A radio frequency circuit (an RF circuit) is connected with each of the antennas via a corresponding matching circuit.

FIG. 2 is a diagram illustrating an example in which in a radio communication terminal including first and second antennas as in the case in the example illustrated in FIG. 1, parasitic elements are prepared for both of the antennas.

In addition, a so-called multiband antenna in which a single antenna includes a plurality of antenna elements so as to cope with a plurality of frequency bands is also proposed. FIG. 3 is a diagram illustrating an example in which a parasitic element is prepared for one (in the example illustrated in FIG. 3, a first antenna) of antenna elements of a multiband antenna of the type as described above. A single radio frequency circuit is connected with the first and second antenna elements via a single matching circuit.

In order to use a parasitic element in any of the above mentioned antenna devices, it may be unavoidable to prepare an additional parasitic element independently of the antenna elements included in the feed antenna. In addition, it may be unavoidable to prepare an area in which the parasitic element is arranged and a component such as a spring or the like used to connect the parasitic element with the ground.

Japanese Laid-open Patent Publication No. 2005-260762 discloses a communication apparatus that includes first and second antennas respectively coping with first and second working frequency bands. In the above mentioned communication apparatus, two switches which are connected with the both antennas are changed over so as to operate one of these two antennas as a feed antenna and to operate another antenna as a parasitic antenna. That is, in the case that one of the antennas is connected with a radio frequency circuit so as to be used as a feed antenna, another antenna is connected with a ground potential so as to be used as a parasitic antenna.

Japanese Laid-open Patent Publication No. 2007-104637 discloses a radio communication terminal that includes a main antenna and a sub antenna used for diversity reception. In the above mentioned radio communication terminal, switches which are respectively connected with the main and sub antennas are changed over so as to function the sub antenna as an antenna used for diversity reception or as a parasitic element for the main antenna.

Japanese Laid-open Patent Publication No. 2004-274445 discloses a radio device that includes first and second antenna elements coping with a plurality of communication systems. In the above mentioned radio device, phasers that are respectively connected with the first and second antenna elements are provided and controlled using a control unit to adjust the impedance on the side of a circuit viewed from a feeding point of the antenna so as to operate, in feeding one antenna element, another antenna element as a parasitic element.

SUMMARY

According to the techniques disclosed in Japanese laid-open Patent Publication Nos. 2005-260762, 2007-104637 and 2004-274445, additional installation of a parasitic element may be eliminated by utilizing an antenna element of a feed antenna as a parasitic element.

However, according to the techniques disclosed in Japanese Laid-open Patent Publication Nos. 2005-260762 and 2007-104637, it may be unavoidable to prepare the switch for the antenna element in order to change over the service state of each antenna and the control unit for controlling the operation of the switch. In the technique disclosed in Japanese Laid-open Patent Publication No. 2004-274445, although the switch is not prepared for the antenna element, it may be unavoidable to prepare the phaser and the control unit for controlling the operation of the phaser.

In addition, in recent years, it becomes desirable for a cell phone terminal to cope with a plurality of communication systems by itself. That is, it becomes desirable to prepare antenna elements individually used for communication over a cell phone system, a BLUETOOTH (a registered trade mark) system and a GPS system that handle frequencies in a plurality of frequency bands. On the other hand, it becomes difficult to retain a space for arranging antenna elements, switches and the like owing to restrictions brought about by downsizing and design of the external form of a cell phone terminal and requirements in performance thereof.

The present invention has been made in view of the above mentioned circumstances. Therefore, it is desirable to utilize at least one antenna element as a parasitic element in an antenna device including a plurality of antenna elements used for feeding, with no provision of a switch used for changing over the service state of each antenna element, and a control wiring, a device and control software used to control the operation of the switch.

According to an embodiment, there is provided an antenna device including a first antenna element configured to resonate at a frequency in a first frequency band, a first matching circuit configured to attain matching between a first radio frequency circuit for the first antenna element and the first antenna element, a second antenna element configured to resonate at a frequency in a second frequency band, a second matching circuit configured to attain matching between a second radio frequency circuit which is connected with the second antenna element and the second antenna element, a first band-pass circuit which is connected with the second antenna element at one end and is connected with the second matching circuit at the other end to selectively conduct a signal which is in the second frequency band, and a second band-pass circuit which is connected with the second antenna element at one end and is grounded at the other end to selectively conduct a signal which is in the first frequency band. In the above mentioned configuration, the second antenna element is utilized as a parasitic element for the first antenna element.

According to an embodiment, there is provided a radio communication terminal including a first antenna element configured to resonate at a frequency in a first frequency band, a first matching circuit, a first radio frequency circuit which is connected with the first antenna element via the first matching circuit, a second antenna element configured to resonate at a frequency in a second frequency band, a second radio frequency circuit which is connected with the second antenna element, a second matching circuit, a first band-pass circuit which is connected with the second antenna element at one end and is connected with the second matching circuit at the other end to selectively conduct a signal which is in the second frequency band, and a second band-pass circuit which is connected with the second antenna element via the second matching circuit at one end and is grounded at the other end to selectively conduct a signal which is in the first frequency band. In the above mentioned configuration, the second antenna element is utilized as a parasitic element for the first antenna element.

According to disclosed embodiments, an existing feed antenna is utilized as a parasitic element, so that preparation of an additional parasitic element may be eliminated. In addition, a switch used to change over the service state of each antenna, a phaser and control units for controlling the operations of the switch and the phaser may be eliminated. Therefore, according to embodiments of the present invention, cost saving and downsizing of the antenna device and the radio communication terminal may be attained.

DESCRIPTION OF THE EMBODIMENTS

Next, embodiments of the present invention will be described in detail with reference to the accompanying drawings.

Figure 1:
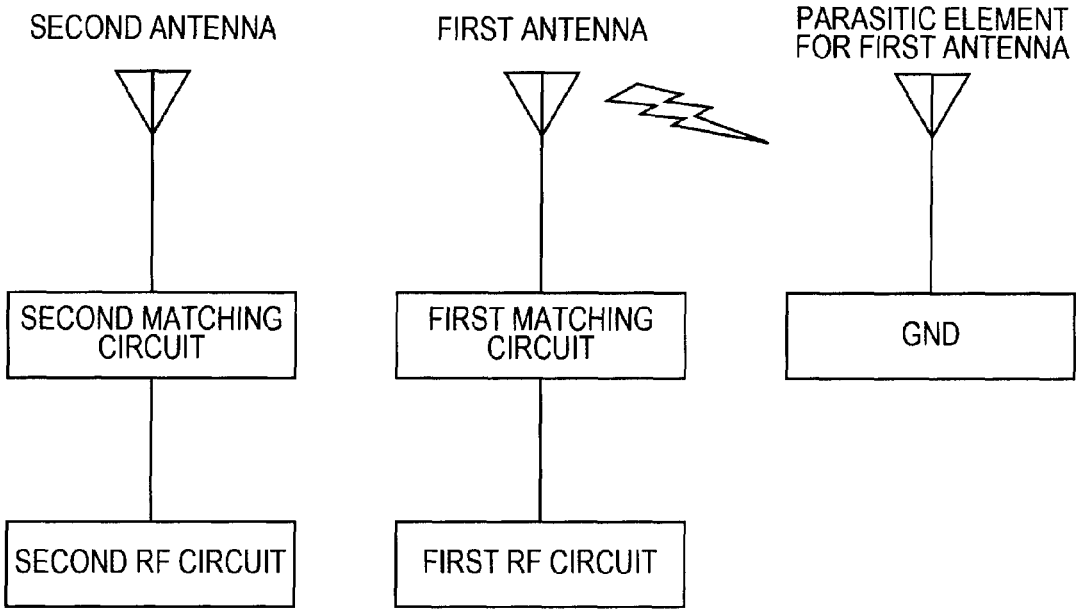
FIG. 1 is a diagram illustrating one example of related art.
Figure 2:
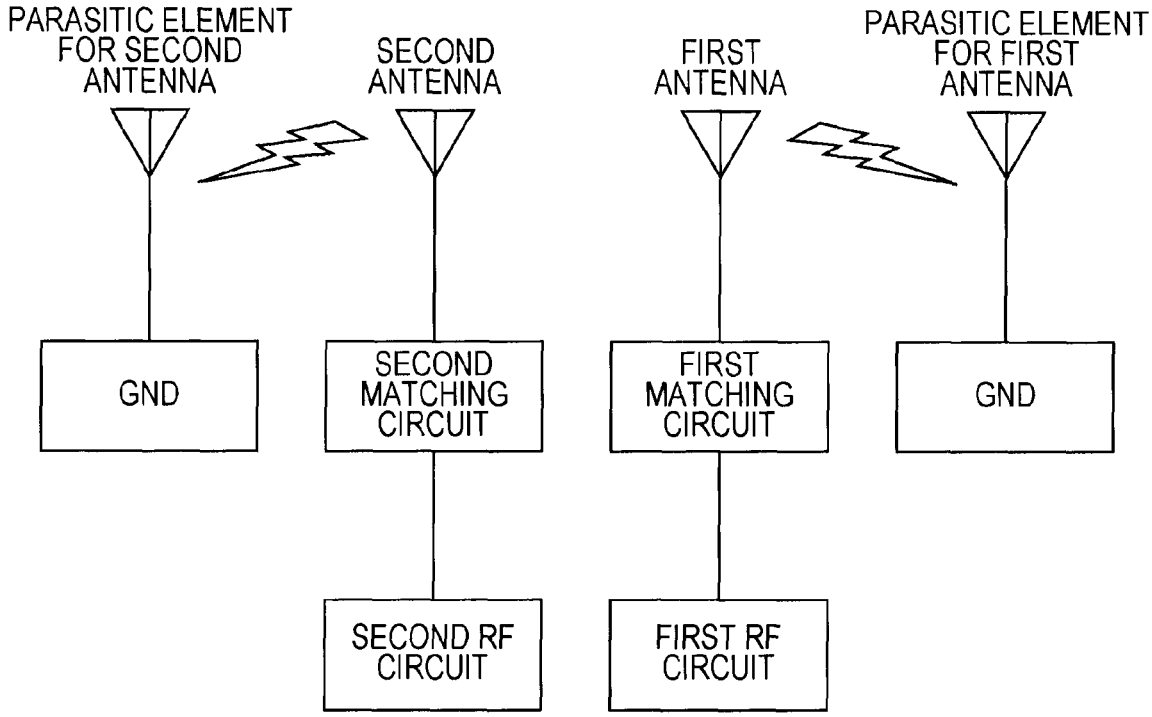
FIG. 2 is a diagram illustrating another example of related art.
Figure 3:
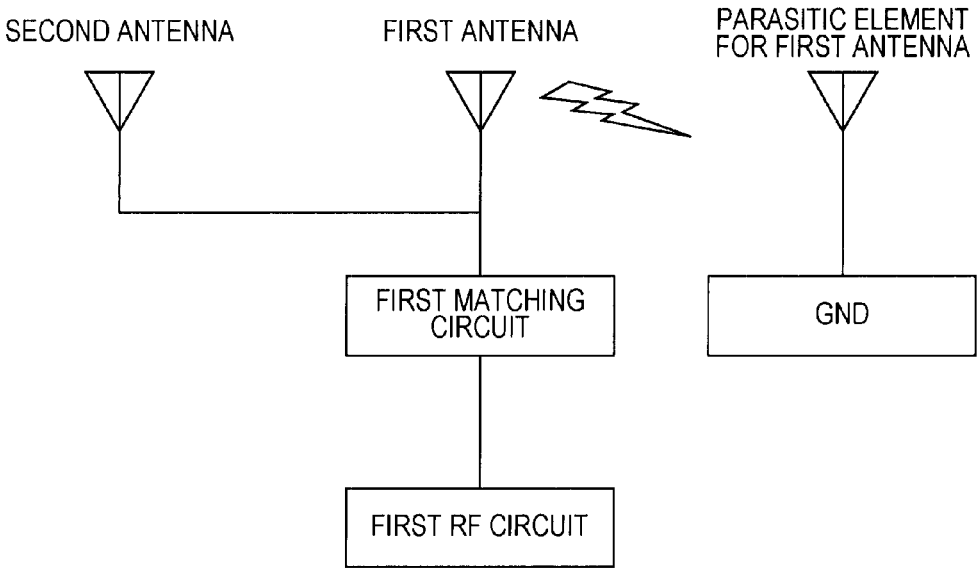
FIG. 3 is a diagram illustrating a further example of related art.
Figure 4:
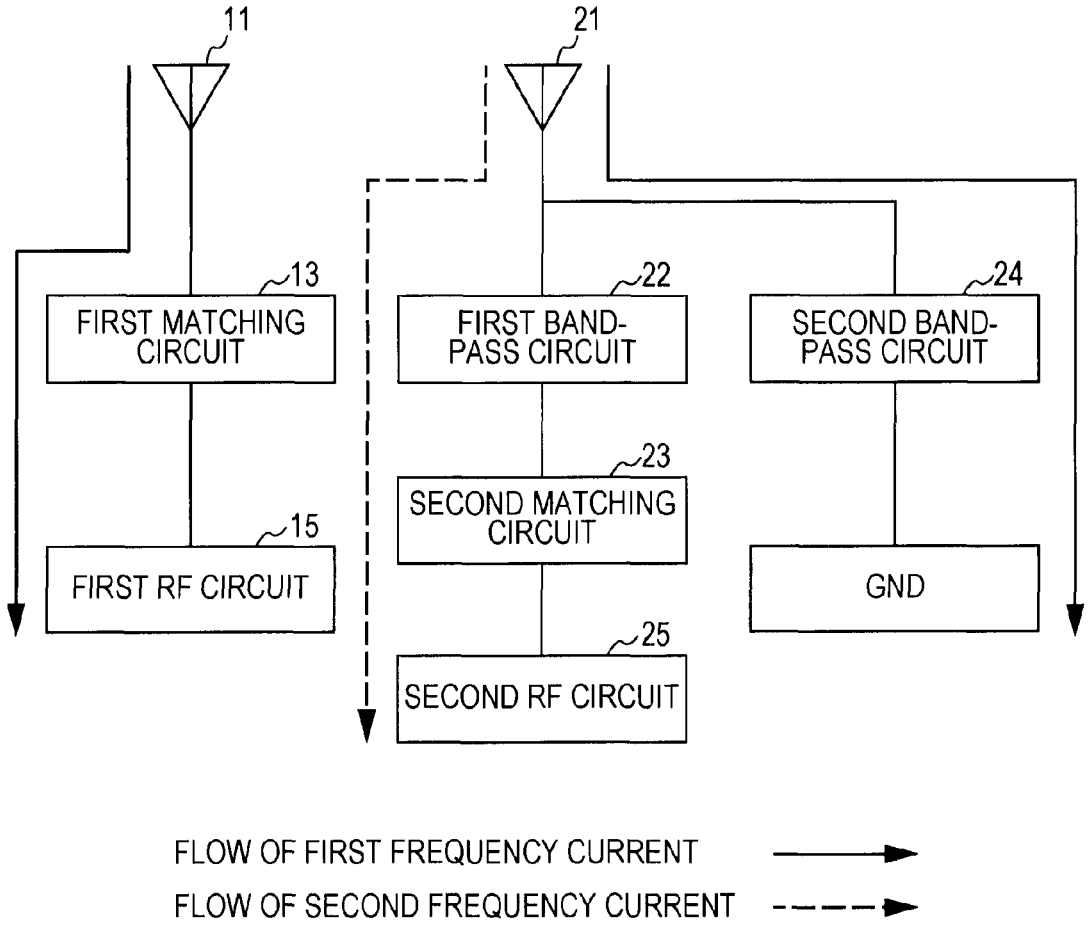
FIG. 4 is a diagram illustrating an example of a configuration of main parts relating to an antenna device for a radio communication terminal according to a first embodiment of the present invention.

FIG. 4 is a diagram illustrating an example of a configuration of main parts relating to an antenna device for a radio communication terminal according to a first embodiment. The radio communication terminal illustrated in FIG. 4 includes two single-hand antennas, that is, a first antenna (a first antenna element) 11 and a second antenna (a second antenna element) 21 that respectively function as feed antennas. The first antenna 11 resonates with a first frequency (a first frequency band) signal to send and receive the signal. The second antenna 21 resonates with a signal which is at a second frequency (a second frequency band) which is different from the first frequency to send and receive the signal. The second antenna 21 functions itself as a feed antenna and also functions as a parasitic element for the first antenna. That is, the antenna device according to the first embodiment is configured to utilize the second antenna 21 as the parasitic element for the first antenna 11 while maintaining its function as the feed signal.

More specifically, the first antenna 11 is connected with a first RF circuit (a radio frequency circuit) 15 via a first matching circuit 13. The first RF circuit 15 includes a send/receive circuit configured to feed the first antenna 11 and to modulate/demodulate signals which are sent and received through the first antenna 11. The first matching circuit 13 is a circuit configured to attain impedance matching between the first antenna 11 and the first RF circuit 15.

The second antenna 21 is connected with a second RF circuit 25 via a first band-pass circuit 22 and a second matching circuit 23 serially. The second RF circuit 25 includes a send/receive circuit configured to feed the second antenna 21 and to modulate/demodulate signals which are sent and received through the second antenna 21. The second matching circuit 23 is a circuit configured to attain impedance matching between the second antenna 21 and the second RF circuit 25. The first band-pass circuit 22 is connected with the second antenna 21 at one end and is connected with the second matching circuit 23 at the other end so as to selectively conduct a second frequency signal (a signal of a frequency which is in the second frequency band). That is, the first band-pass circuit 22 which is connected with the second antenna 21 operates to conduct a second frequency current (illustrated by a broken-line arrow in FIG. 4) and not to conduct a first frequency current (illustrated by a solid-line arrow in FIG. 4).

The second antenna 21 is grounded via a second band-pass circuit 24. The second band-pass circuit 24 operates to conduct the first frequency current and not to conduct the second frequency current.

Owing to a configuration as mentioned above, the second antenna 21 performs its original function as a radio communication antenna (a feed antenna) and also functions as a parasitic element for the first antenna 11. As a result, the antenna characteristic of the first antenna 11 may be improved. In the configuration illustrated in FIG. 4, the second antenna 21 that functions as the parasitic element is directly connected with the first and second band-pass circuits 22 and 24 and means (a switch) for changing over a state of connection between it and one of the first and second band-pass circuits 22 and 24 is not disposed. Thus, the second antenna 21 is allowed to perform its original function as the radio communication antenna and the function as the parasitic element simultaneously, without the need to switch between functional configurations. In turn, this allows for simultaneous one-way or two-way use of both antennas.

In addition, owing to the configuration illustrated in FIG. 4, a dedicated antenna element for use as a parasitic element may be eliminated. In addition, a switch and a phaser, and control wirings, devices and control software which will be used to control the operations of the switch and the phase may be eliminated. As a result, saving of a space used for arranging components and of a cost involved in arrangement of components may be attained.

Figure 5:
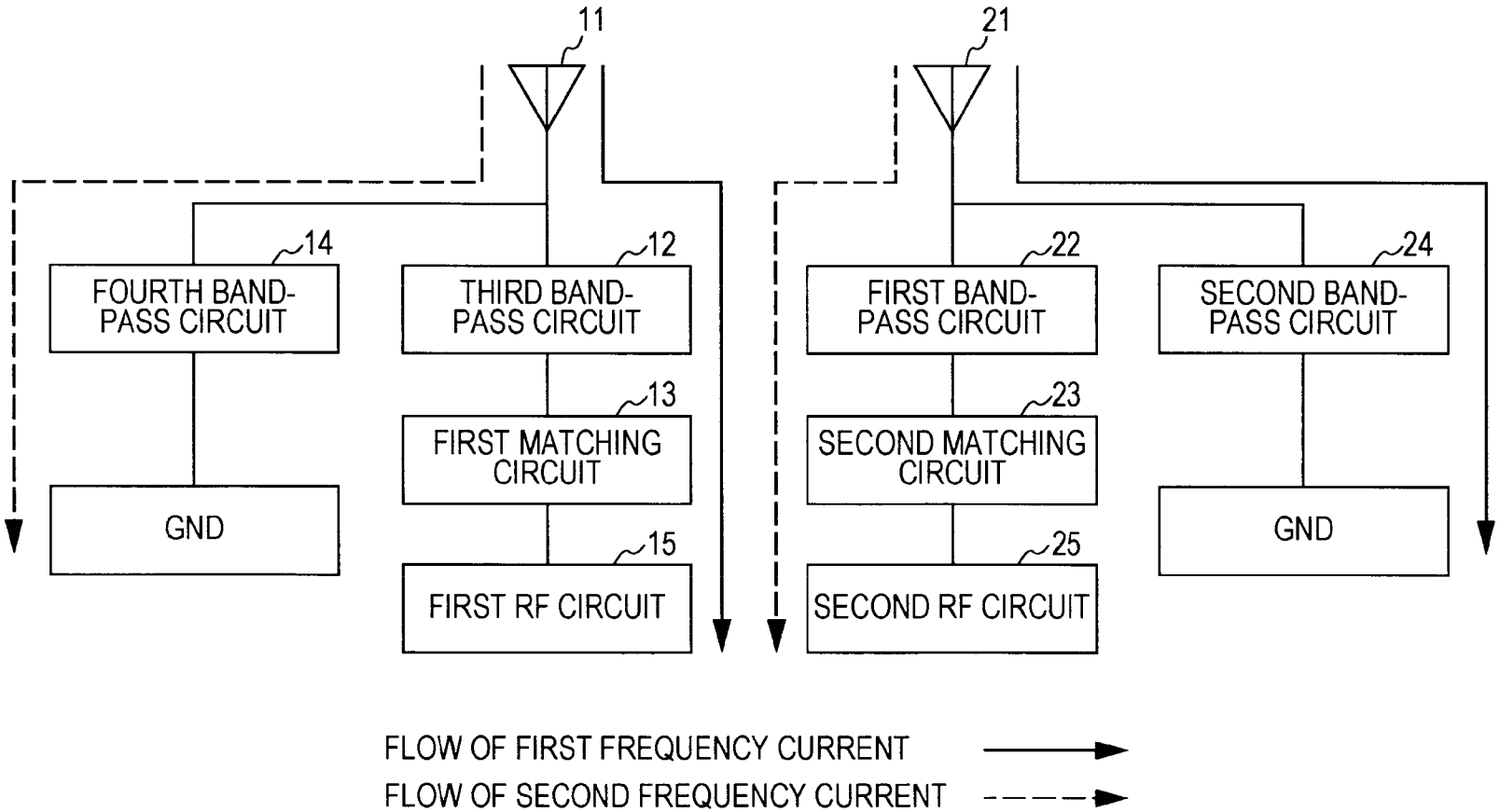
FIG. 5 is a diagram illustrating an example of a configuration of main parts relating to an antenna device for a radio communication terminal according to a second embodiment of the present invention.

FIG. 5 is a diagram illustrating an example of a configuration of main parts relating to an antenna device for a radio communication terminal according to a second embodiment of the present invention. Incidentally, the same numerals are assigned to the same constitutional elements as those illustrated in FIG. 4 and repetitive description thereof will be omitted. As in the case of the configuration of the terminal according to the first embodiment illustrated in FIG. 4, the radio communication terminal illustrated in FIG. 5 includes two single-hand antenna devices. Unlike the configuration according to the first embodiment, in the configuration according to the second embodiment, the first antenna 11 is also configured to be utilized as a parasitic element for the second antenna 21. That is, the first antenna 11 is connected with the first matching circuit 13 via a third band-pass circuit 12 and is grounded via a fourth band-pass circuit 14. The third band-pass circuit 12 operates to conduct the first frequency current and not to conduct the second frequency current. The fourth band-pass circuit 14 operates to conduct the second frequency current and not to conduct the first frequency current.

Owing to the configuration illustrated in FIG. 5, the first antenna 11 and the second antenna 21 are allowed to perform their original functions as the radio communication antennas and to function as parasitic elements respectively for the second antenna 21 and the first antenna 11 simultaneously.

Figure 6:
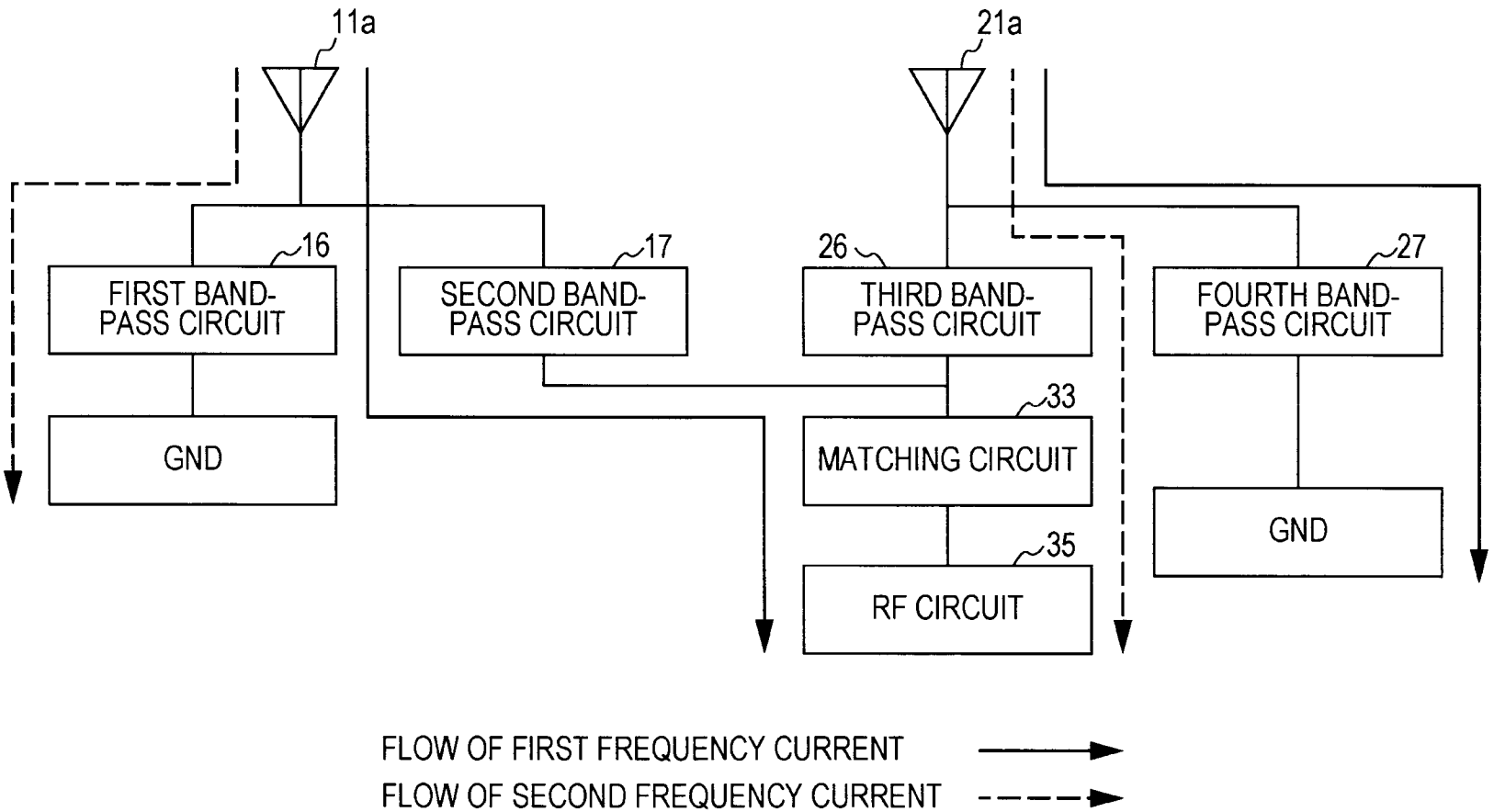
FIG. 6 is a diagram illustrating an example of a configuration of main parts relating to an antenna device for a radio communication terminal according to a third embodiment of the present invention.

FIG. 6 is a diagram illustrating an example of a configuration of main parts relating to an antenna device for a radio communication terminal according to a third embodiment of the present invention. Incidentally, the same numerals are assigned to the same constitutional elements as those illustrated in FIG. 5 and repetitive description thereof will be omitted. The radio communication terminal according to the third embodiment is of the type equipped with a so-called multiband antenna device configured such that a single antenna device includes, for example, a first element 11*a* and a second element 21*a* as a plurality of antenna elements coping with a plurality of frequency bands. The first element 11*a* is connected with an RF circuit 35 via a second band-pass circuit 17 and a matching circuit 33 serially and is grounded via a first band-pass circuit 16. The second element 21*a* is connected with an RF circuit 35 via a third band-pass circuit 26 and a matching circuit 33 serially and is grounded via a fourth band-pass circuit 27.

Although in the configuration illustrated in FIG. 6, it is assumed to attain matching between the first element 11*a* and the RF circuit 35 and between the second element 21*a* and the RF circuit 35 using a single circuit, that is, the matching circuit 33, the matching may be attained using separately disposed matching circuits. In FIG. 6, although the RF circuit 35 is illustrated as a single circuit, it substantially has the same functions as those of the first RF circuit 15 and the second RF circuit 25 illustrated in FIG. 5.

As described above, one antenna element may be utilized as the parasitic element for another antenna element even among a plurality of antenna elements of the multiband antenna device. In addition, as described above, saving of the space used for arranging components and the cost involved in arrangement of the components may be promoted.

Figure 7:
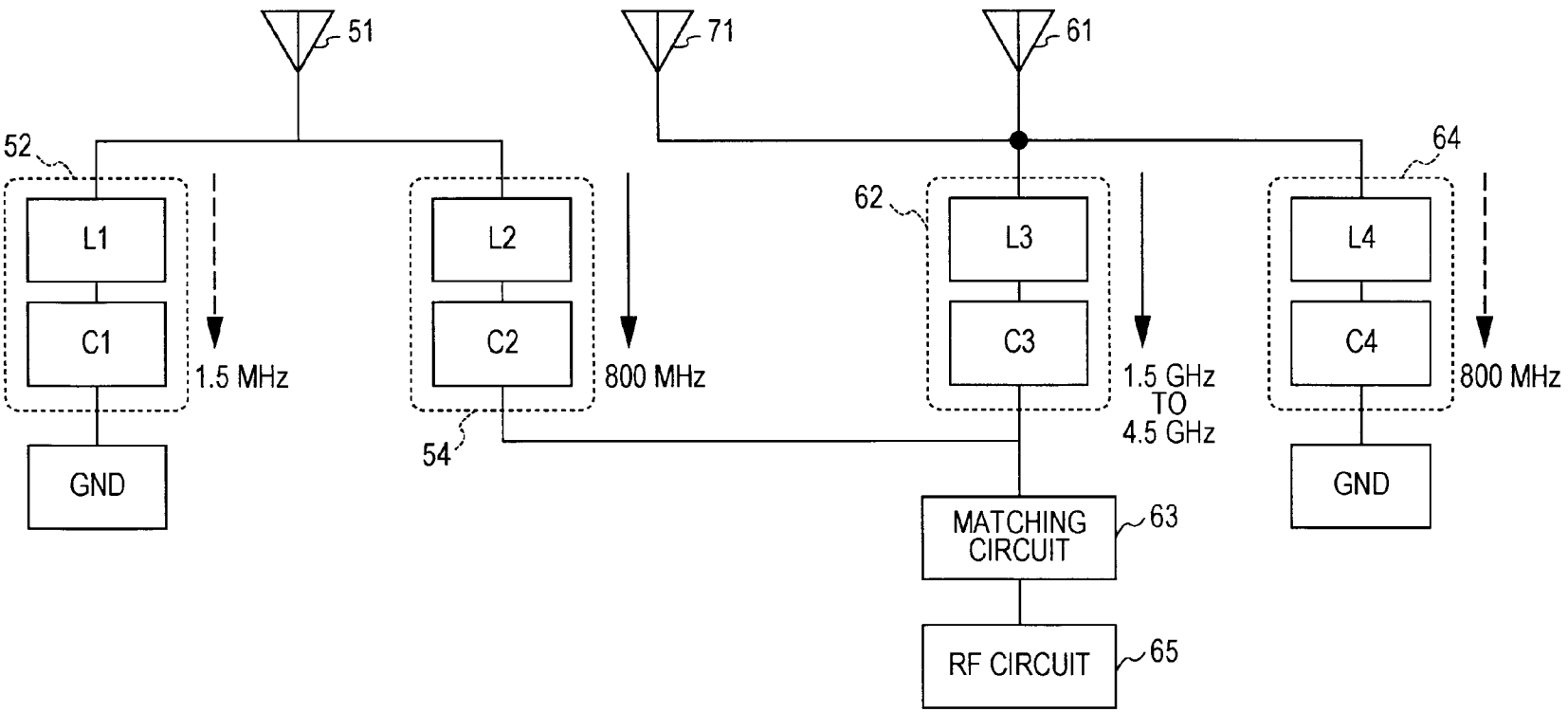
FIG. 7 is a diagram illustrating a specific example to which the configuration according to the third embodiment illustrated in FIG. 6 is applied.

FIG. 7 is a diagram illustrating a specific example to which the configuration according to the third embodiment illustrated in FIG. 6 is applied. A radio communication terminal illustrated in FIG. 7 is of the type equipped with a multiband antenna device configured such that a single antenna device includes, for example, a first element 51, a second element 61 and a third element 71 as a plurality of antenna elements coping with a plurality of frequency bands. In the above example, a cell phone terminal having a cell phone function and its diversity reception function coping with two frequency bands of an 800-MHz band (843 MHz to 875 MHz) and a 2-GHz band, a BLUETOOTH communication function, and a GPS function is supposed.

The first element 51 functions as a sub antenna for diversity reception in the 800-MHz band and also functions as a parasitic element for a GPS antenna element which will be described later. The second element 61 functions as the GPS antenna element (a 1.5-GHz band) and also functions as a parasitic element for the first element 51 that functions as the sub antenna for 800-MHz band diversity reception. The third element 71 functions as a Bluetooth (2.4 GHz) antenna and also functions as a sub antenna for 2-GHz band diversity reception. In the above mentioned example, parasitic elements for the Bluetooth antenna and the sub antenna for 2-GHz band diversity reception which are the functions of the third element 71 are not provided. The reason for the above lies in that the diagram in FIG. 7 merely illustrates an example of a configuration which is applied to the functions of the actual cell phone terminal and according to an embodiment of the present invention, presence of the third element 71 and its functions may not be so indispensable.

Although additional antenna elements of the main antenna that cope with two frequency bands of the 800-MHz band and the 2-GHz band of the cell phone are included as elements for performing the diversity reception function, these elements are not illustrated in FIG. 7 (see FIG. 11 which will be described later).

Each of first to fourth band-pass circuits 52, 54, 62 and 64 includes a reactance circuit which is a combination of an inductor and a capacitor. In the example illustrated in FIG. 7, the first band-pass circuit 52 includes an inductor L1 and a capacitor C1 which are serially connected with each other. The second band-pass circuit 54 includes an inductor L2 and a capacitor C2 which are serially connected with each other. The third pass-band circuit 62 includes an inductor L3 and a capacitor C3 which are serially connected with each other. The fourth pass-band circuit 64 includes an inductor L4 and a capacitor C4 which are serially connected with each other. The inductance value of the inductor and the capacitance value of the capacitor of each pass-band circuit are respectively selected to have predetermined values as will be described later. The second band-pass circuit 54 and the third band-pass circuit 62 are connected with an RF circuit 65 via a common matching circuit 63 in the same manner as that illustrated in FIG. 6.

Next, impedances of the first to fourth band-pass circuits 52, 54, 62 and 64 illustrated in FIG. 7 will be described using Smith impedance charts illustrated in FIGS. 8A to 9B. Each drawing illustrates the frequency characteristic of the impedance (the impedance observed from the other end of the circuit in a state in which one end thereof is grounded) of each band-pass circuit itself.

Figure 8A:
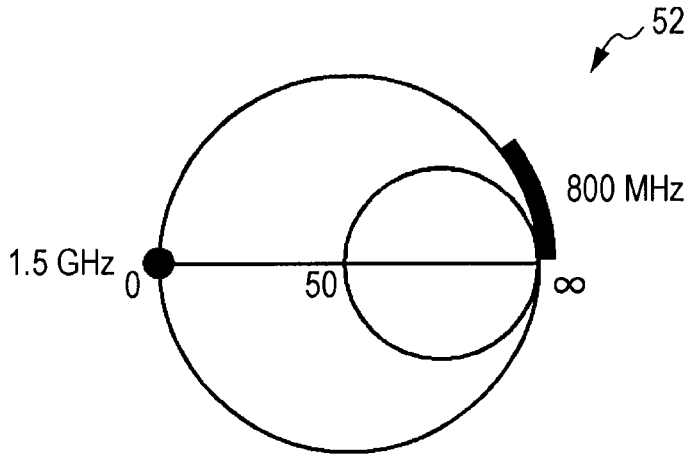
FIG. 8A is a diagram illustrating an example of a Smith impedance chart illustrating an impedance of a first band-pass circuit according to an embodiment of the present invention.
Figure 8B:
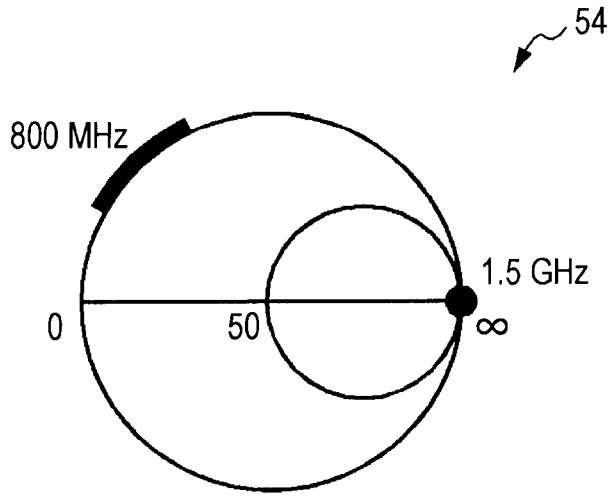
FIG. 8B is a diagram illustrating an example of a Smith impedance chart illustrating an impedance of a second band-pass circuit according to an embodiment of the present invention.

FIGS. 8A and 8B are diagrams illustrating examples of impedances of the first band-pass circuit 52 and the second band-pass circuit 54 which are plotted on Smith impedance charts.

The values of the inductor L1 and the capacitor C1 of the first band-pass circuit 52 are selected (adjusted) such that the circuit indicates a high impedance value at a frequency in the 800-MHz band and the first element 51 resonates at a frequency in the 1.5-GHz band. The impedance characteristic of the first band-pass circuit 52 which is obtained when so selected is as illustrated in FIG. 8A. That is, the first band-pass circuit 52 indicates an almost infinite impedance value at a frequency in the 800-MHz band and a zero impedance value at a frequency in the 1.5-GHz band.

The values of the inductor L2 and the capacitor C2 of the second band-pass circuit 54 are selected such that the circuit indicates a high impedance value at a frequency in the 1.5-GHz band and the first element 51 resonates at a frequency in the 800-MHz band. The impedance characteristic of the second band-pass circuit 52 which is obtained when so selected is as illustrated in FIG. 8B. That is, the second band-pass circuit 54 indicates an almost infinite impedance value at a frequency in the 1.5-GHz band and an almost zero impedance value at a frequency in the 800-MHz band.

Figure 9A:
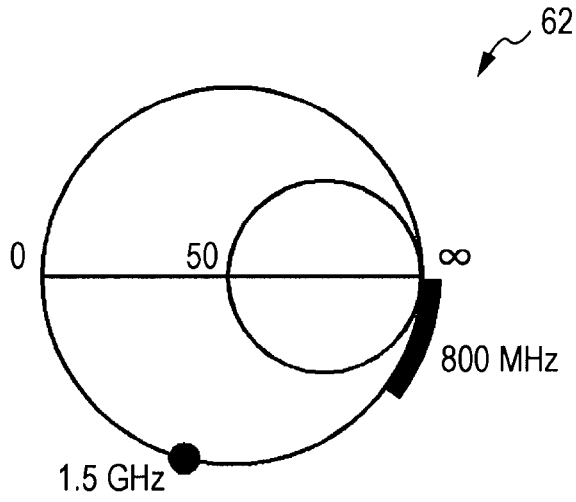
FIG. 9A is a diagram illustrating an example of a Smith impedance chart illustrating an impedance of a third band-pass circuit according to an embodiment of the present invention.
Figure 9B:
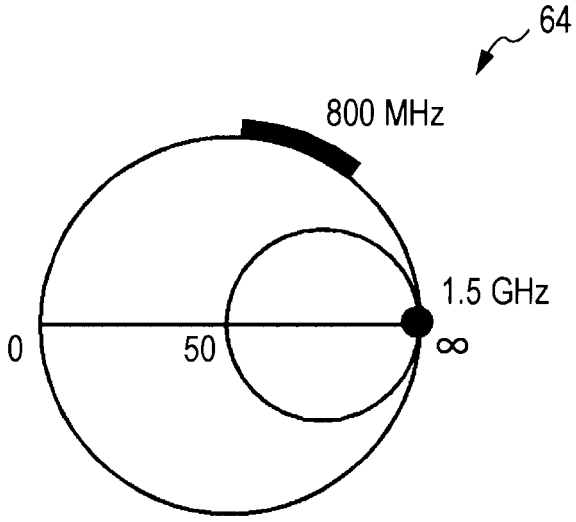
FIG. 9B is a diagram illustrating an example of a Smith impedance chart illustrating an impedance of a fourth band-pass circuit according to an embodiment of the present invention.

FIGS. 9A and 9B are diagrams illustrating examples of impedances of the third band-pass circuit 62 and the fourth band-pass circuit 64 which are plotted on Smith impedance charts.

The values of the inductor L3 and the capacitor C3 of the first band-pass circuit 62 are selected (adjusted) such that the circuit indicates a high impedance value at a frequency in the 800-MHz band and the second element 61 resonates at a frequency in the 1.5-GHz band. The impedance characteristic of the third band-pass circuit 62 which is obtained when so selected is as illustrated in FIG. 9A. That is, the third band-pass circuit 62 indicates an almost infinite impedance value at a frequency in the 800-MHz band and a zero impedance value at a frequency in the 1.5-GHz band. Incidentally, the reason why the impedance value obtained at a frequency in the 1.5-GHz band is situated at a position obtained by rotating it from a pure resistance position downward (toward the capacitive reactance side) on the Smith impedance chart lies in that in the example illustrated in FIG. 7, the second element 61 and the third element 71 are connected with the third band-pass circuit 62 and a reactance value obtained incidentally to these elements so connected is reflected.

The values of the inductor L4 and the capacitor C4 of the fourth band-pass circuit 54 are selected such that the circuit indicates a high impedance value at a frequency in the 1.5-GHz band and the second element 61 resonates at a frequency in the 800-MHz band. The impedance characteristic of the second band-pass circuit 52 which is obtained when so selected is as illustrated in FIG. 9B. That is, the fourth band-pass circuit 64 indicates an almost infinite impedance value at a frequency in the 1.5-GHz band and an almost zero impedance value at a frequency in the 800-MHz band. Incidentally, the reason why the impedance value obtained at a frequency in the 800-MHz band is situated at a position obtained by rotating it from a pure resistance position upward (toward the inductive reactance side) on the Smith impedance chart lies in that in the example illustrated in FIG. 7, the second element 61 and the third element 71 are connected with the third band-pass circuit 62 and a reactance value obtained incidentally to these elements so connected is reflected.

Figure 10A:
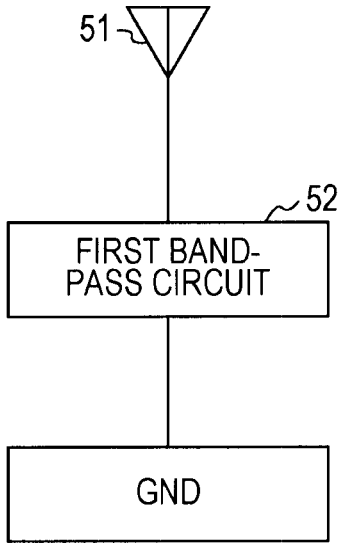
FIG. 10A is a diagram illustrating an example of a configuration for adjusting a resonance frequency of the first element which may function as a parasitic element for GPS according to the embodiment illustrated in FIG. 4.
Figure 10B:
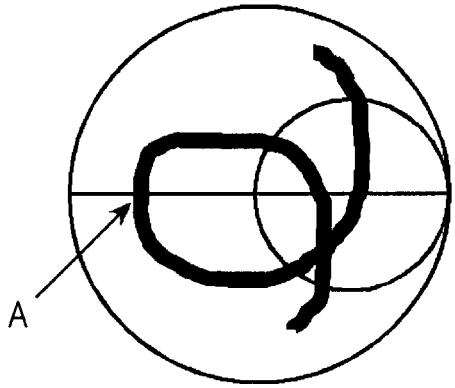
FIG. 10B is a diagram illustrating an example of an impedance of the first element which may function as a parasitic element for GPS according to the embodiment illustrated in FIG. 4.

For example, in the case that the resonance frequency of the first element 51 is adjusted so as to function as the parasitic element for GPS, the second band-pass circuit 54 is disconnected as illustrated in an example in FIG. 10A and the impedance characteristic of the first element 51 which is observed through the first band-pass circuit 52 via a coaxial cable is measured. A frequency at which the impedance so measured indicates a pure resistance value (a point A in FIG. 10B) is the resonance frequency of the parasitic element concerned as illustrated in an example in FIG. 10B. Then, the values of the inductor L1 and the capacitor C1 used in the first band-pass circuit 52 are selected (adjusted) such that the resonance frequency has a desired frequency value (1.5 GHz in the example illustrated in FIG. 10B). Then, the above mentioned values are selected (adjusted) such that the circuit indicates a high impedance value at a frequency in the 800-MHz band without changing the impedance value obtained at 1.5 GHz in a state in which the first element 51 is disconnected and is grounded.

Likewise, the values of the inductor L2 and the capacitor C2 of the second band-pass circuit 54 are determined so as to obtain a resonance frequency at which the second element functions as the parasitic element for the first element 51 which is used for 800 MHz-band diversity reception.

The values of the inductor L3 and the capacitor C3 of the third band-pass circuit 62 and the inductor L4 and the capacitor C4 of the fourth band-pass circuit 64 are determined basically in the same manner as the above. However, since the third element 71 is parallel-connected with the second element 61, adjustment of the L and C values of the band-pass circuit may be complicated accordingly. As a method of adjusting the L and C values, for example, first, the L and C values of the fourth band-pass circuit 64 and the third band-pass circuit 62 are adjusted with respect to the second element 61 and then the length of the third element 71 is adjusted.

Figure 11B:
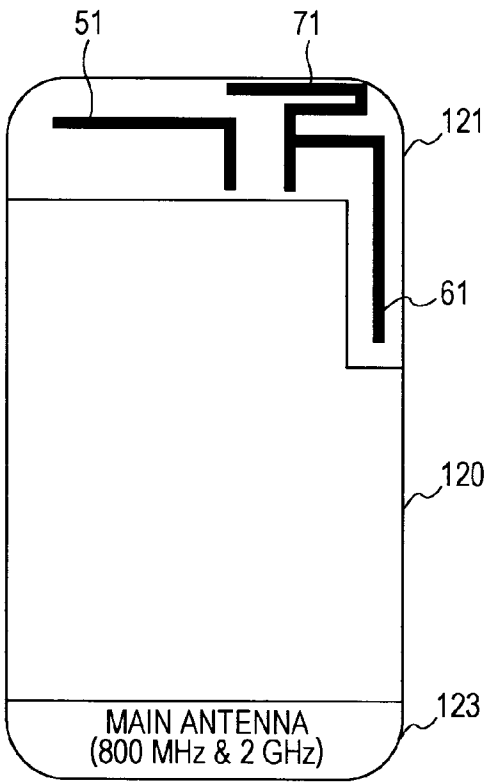
FIG. 11B is a front view illustrating an example in which a configuration illustrated in FIG. 7 is applied to a cell phone terminal.
Figure 11A:
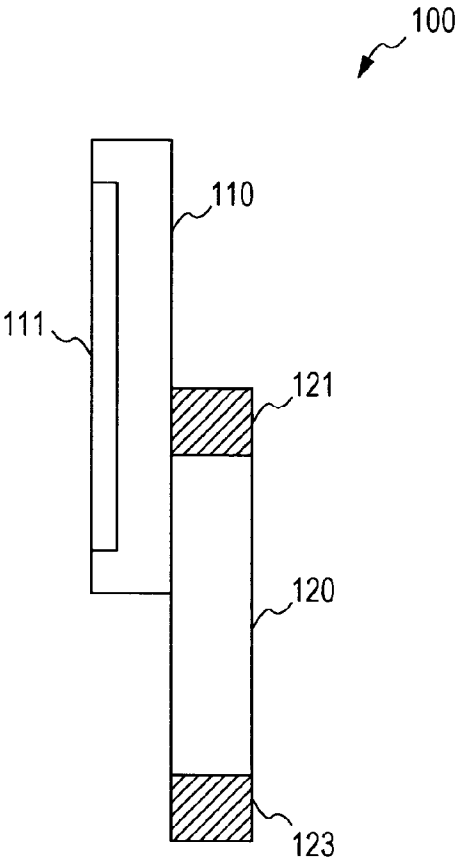
FIG. 11A is a side view illustrating an example in which a configuration illustrated in FIG. 7 is applied to a cell phone terminal.

FIGS. 11A and 11B are diagrams illustrating an example in which an antenna device which adopts the configuration illustrated in FIG. 7 is applied as an antenna device in a cell phone terminal 100. The cell phone terminal 100 includes an upper case 110 into which a display unit (an LCD) 111 is built and a lower case 120 which is slidably coupled to the upper case 110. A main antenna 123 is disposed on a lower end of the lower case 120 and a multiband antenna device 121 is disposed on its upper end. The multiband antenna device 121 includes the first element 51, the second element 61 and the third element 71. In the example illustrated in FIGS. 11A and 11B, the main antenna 123 is also configured as the multiband antenna coping with a plurality of frequency bands. Although a sliding type cell phone terminal is illustrated by way of example, the cell phone terminal used is not limited to the sliding type one.

Figure 12:
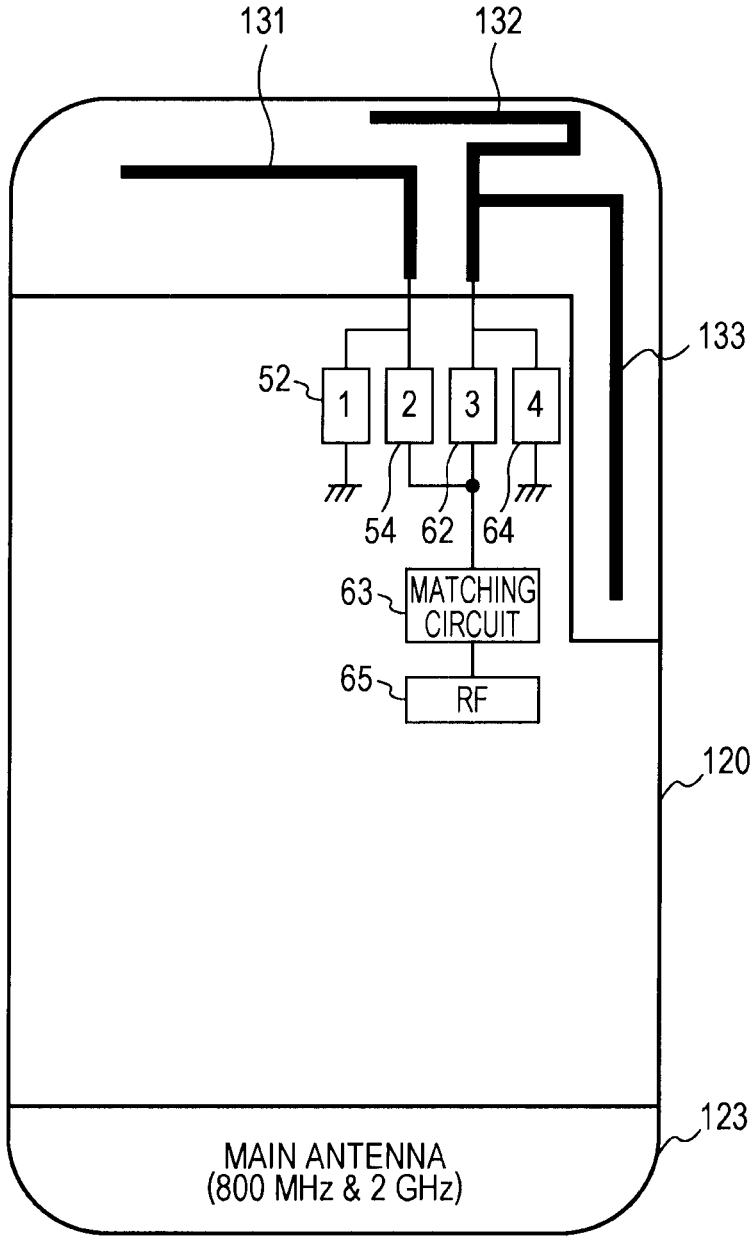
FIG. 12 is a diagram of an example of a configuration illustrating a mutual-connecting relation among band-pass circuits, a matching circuit and an RF circuit connected with respective antenna patterns of a first element, a second element and a third element according to an embodiment of the present invention.

FIG. 12 is a diagram illustrating an example of a mutual connecting relation among the band-pass circuits (BPFs: Band Pass Filters) 52, 54, 62 and 64, the matching circuit 63 and the RF circuit 65 to be connected with respective antenna elements (that is, conductor patterns) of the first element 51, the second element 61 and the third element 71. The band-pass circuits 52, 54, 62 and 64, the matching circuit 63 and the RF circuit 65 are disposed on a circuit board (not illustrated in the drawing).

Figure 13A:
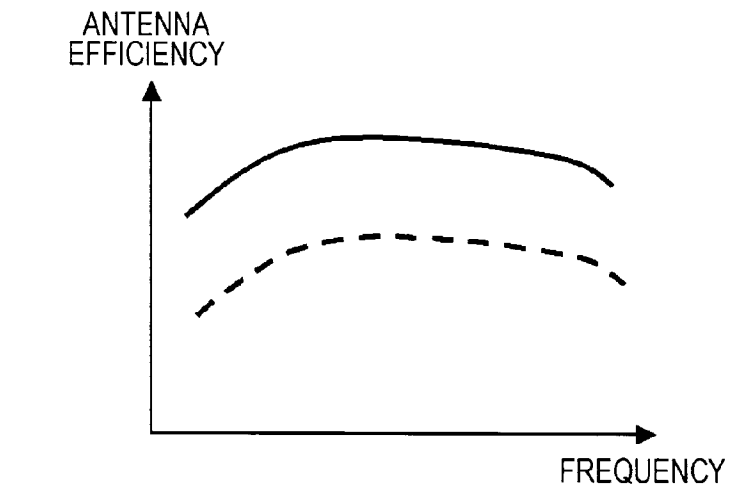
FIG. 13A is a diagram illustrating an example of an advantageous effect which may be brought about by a cell phone terminal such as, for example, the cell phone terminal illustrated in FIG. 12.
Figure 13B:
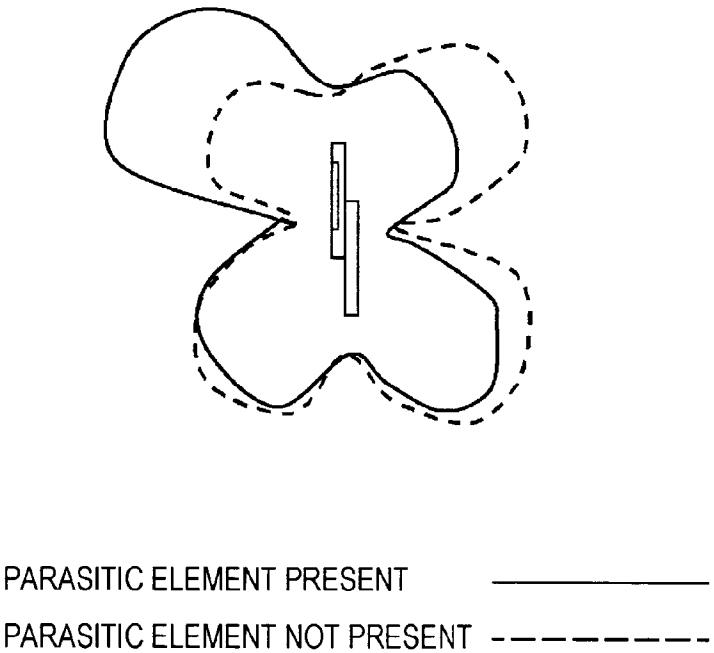
FIG. 13B is a diagram illustrating an example of an advantageous effect which may be brought about by a cell phone terminal such as, for example the cell phone terminal illustrated in FIG. 12.

FIGS. 13A and 13B are diagrams illustrating examples of advantageous effects which may be brought about by a cell phone terminal such as, for example, the cell phone terminal 100 illustrated in FIG. 12. FIG. 13A illustrates an example of improvement in antenna effect which may be attained in the presence of a parasitic element as compared with a case in which any parasitic element is not prepared. FIG. 13B illustrates an example of control of directivity attained in the presence of the parasitic element as compared with a case in which any parasitic element is not prepared.

According to embodiments of the present invention, an element to be dedicatedly used as a parasitic element may be eliminated and a switch and a phaser, and control wirings, devices and control software used to control the operations of the switch and the phaser may be eliminated. As a result, saving of a space used for arranging components and a cost involved in component arrangement may be promoted. In reality, according to embodiments of the present invention, the size of an inductor included in a band-pass circuit may be reduced to about 1 mm×0.5 mm, the size of a capacitor included in the band-pass circuit may be reduced to about 0.6 mm×0.3 mm, and an increase in the arrangement space caused by installation of the band-pass circuits is so small as to be negligible.

Although embodiments have been described, the embodiments may be altered and modified in a variety of ways in addition to the above mentioned alterations and modifications. For example, although as an example of the band-pass circuit, a circuit in which an inductor and a capacitor are serially connected with each other has been given, the configuration of the band-pass circuit may not be limited thereto. In addition, the number of indictors included in the band-pass circuit may not be limited to one. Likewise, the number of capacitors included in the band-pass circuit may not be limited to one. Connection between them may not be limited to serial connection. Although as an example of the kind of the antenna, a mono-pole antenna has been given, the present invention may be applied to any kind of antenna. Although as examples of systems to which the antennas according to embodiments of the present invention are applied, a cell phone system, a GPS communication system and a Bluetooth communication system have been given, the antennas may be applied to other systems such as, for example, a One Segment Digital Terrestrial Broadcasting system, a wireless LAN system and the like. In addition, the antennas according to embodiments of the present invention may be also applied to antennas dedicated to data send and antennas dedicated to data receive, not limited to application to the send/receive antennas.

What is claimed is:

1. An antenna device comprising:

a first antenna element configured to resonate in a first frequency band;

a first matching circuit that impedance matches a first radio frequency circuit with the first antenna element;

a second antenna element configured to resonate in a second frequency band;

a second matching circuit that impedance matches a second radio frequency circuit with the second antenna element;

a first band-pass circuit connected to the second antenna element at one end and connected to the second matching circuit at the other end, and having a passband covering the second frequency band; and a second band-pass circuit connected to the second antenna element at one end and grounded at the other end, and having a passband covering the first frequency band so the second antenna element serves as a parasitic element for the first antenna element.

2. The antenna device of claim 1, wherein the second band-pass circuit shunts signals in the first passband to ground while blocking signals in the second passband.

3. The antenna device of claim 1, wherein said antenna device operates said first antenna element and said second antenna elements simultaneously, with said second antenna element serving as a parasitic element without including a switch.

4. The antenna device of claim 1, wherein, said first band-pass circuit blocks signals in the first frequency band, but passes signals in the second frequency band.

5. The antenna device of claim 1, further comprising:

a third band-pass circuit that interconnects said first impedance matching circuit with said first antenna element, and having a passband that blocks signals in the second frequency band but passes signals in the first frequency band.

6. The antenna device of claim 5, further comprising:

a fourth band-pass circuit connected to the first antenna element at one end and grounded at the other end, and having a passband covering the second frequency band so the first antenna element serves as a parasitic element for the second antenna element.

7. The antenna device of claim 1, wherein said first passband includes 800 MHz.

8. The antenna device of claim 1, wherein said second passband includes at least one of 1.5 GHz and 2 GHz.

9. The antenna device of claim 1, wherein said antenna device being included in a mobile communications device that supports at least two of 3G, GPS, and Bluetooth communications.

10. An antenna device comprising:

a first antenna element configured to resonate in a first frequency band;

a first matching circuit that impedance matches a first radio frequency circuit with the first antenna element and a third band-pass circuit;

a second antenna element configured to resonate in a second frequency band;

a second matching circuit that impedance matches a second radio frequency circuit with the second antenna element and a first band-pass circuit;

the first band-pass circuit connected to the second antenna element at one end and connected to the second matching circuit at the other end, and having a passband covering the second frequency band;

a second band-pass circuit connected to the second antenna element at one end and grounded at the other end, and having a passband covering the first frequency band so the second antenna element serves as a parasitic element for the first antenna element; and the third band-pass circuit that interconnects said first impedance matching circuit with said first antenna element, and having a passband that blocks signals in the second frequency band but passes signals in the first frequency band.

11. The antenna device of claim 10, further comprising:

a fourth band-pass circuit connected to the first antenna element at one end and grounded at the other end, and having a passband covering the second frequency band so the first antenna element serves as a parasitic element for the second antenna element.

12. The antenna device of claim 11, wherein said antenna device being included in a mobile communications device that supports at least two of 3G, GPS, and Bluetooth communications.

13. The antenna device of claim 10, wherein said first passband includes 800 MHz.

14. The antenna device of claim 10, wherein said second passband includes at least one of 1.5 GHz and 2 GHz.

15. An antenna device comprising:

a first antenna element configured to resonate in a first frequency band;

a second antenna element configured to resonate in a second frequency band;

a matching circuit that impedance matches a radio frequency circuit with the first antenna element and with a combination of the second antenna element and a third band-pass circuit;

a first band-pass circuit connected to the first antenna element at one end and connected to ground at the other end, and having a passband covering the second frequency band; and a second band-pass circuit connected to the first antenna element and the matching circuit at the other end, and having a passband covering the first frequency band;

the third band-pass circuit that interconnects said second antenna element and said matching circuit and has a passband that covers the second frequency band; and a fourth band-pass circuit that is connected between the second antenna element and ground, and having a passband that covers the first frequency band.

16. The antenna device of claim 15, wherein said antenna device being included in a mobile communications device that supports at least two of 3G, GPS, and Bluetooth communications.

17. The antenna device of claim 16, wherein said first passband includes 800 MHz.

18. The antenna device of claim 16, wherein said second passband includes at least one of 1.5 GHz and 2 GHz.

* * * * *